US005303489A

United States Patent [19]

Blegen

[11] Patent Number: 5,303,489

[45] Date of Patent: Apr. 19, 1994

[54] COMBINED MAGNETIC PICTURE FRAME AND GIFT/DISPLAY CARD

[76] Inventor: William E. Blegen, 20295 Manor Rd., Shorewood, Minn. 55331

[21] Appl. No.: 956,745

[22] Filed: Oct. 5, 1992

Related U.S. Application Data

[63] Continuation-in-part of Ser. No. 847,115, Mar. 6, 1992, Pat. No. 5,261,174.

[51] Int. Cl.[5] ..... G09F 1/12

[52] U.S. Cl. ..... 40/152; 40/600

[58] Field of Search ..... 40/600, 152, 594, 154, 40/156, 159, 159.1, 124.1

[56] References Cited

U.S. PATENT DOCUMENTS

| | | | |
|---|---|---|---|
| 1,038,652 | 9/1912 | Reese | 40/152 |
| 2,176,535 | 10/1939 | Markoff | 40/159 |
| 3,210,080 | 10/1965 | Rael et al. . | |
| 4,200,222 | 4/1980 | Feuer . | |
| 4,439,941 | 4/1984 | Halperin | 40/124.1 |
| 4,785,562 | 11/1988 | Good | 40/159.1 |
| 4,912,864 | 4/1990 | Price | 40/155 |
| 4,951,969 | 8/1990 | Epstein et al. . | |
| 4,975,137 | 12/1990 | Cross . | |
| 4,987,692 | 1/1991 | Fast . | |
| 4,989,355 | 2/1991 | Thomas . | |
| 5,001,853 | 3/1991 | Odien . | |
| 5,002,181 | 3/1991 | Leppo . | |
| 5,004,271 | 4/1991 | Piatt . | |
| 5,009,624 | 4/1991 | Estam-Goggin . | |
| 5,010,669 | 4/1991 | Moran . | |
| 5,014,455 | 5/1991 | Desaderata . | |
| 5,022,681 | 6/1991 | Penick . | |

FOREIGN PATENT DOCUMENTS

| | | | |
|---|---|---|---|
| 1085593 | 10/1967 | United Kingdom . | |
| 2032670 | 5/1980 | United Kingdom | 40/600 |
| WO88/01419 | 2/1988 | World Int. Prop. O. . | |

OTHER PUBLICATIONS

Two-Ad from Parents magazine, Nov. 1991, entitled "Even Our Most Beautiful Frames are Tacky", 3M Consumer Statinery Division.

Sample of "Flashbacks" instant photo framer, entitled "The Daily Journal", 3M Consumer Stationery Division.

*Primary Examiner*—Kenneth J. Dorner
*Assistant Examiner*—J. Bonifanti
*Attorney, Agent, or Firm*—Merchant, Gould, Smith, Edell, Welter & Schmidt

[57] ABSTRACT

A picture frame made from a flexible magnetic sheet material is disclosed which is part of a mailer including a gift card and envelope. The gift card has a front surface carrying parallel strips of double-sided adhesive tape each having an outwardly facing releasable adhesive on one side to which the picture frame can be attached to display a photograph between the picture frame and card. The recipient of the mailer can peel the flexible picture frame from the card, remove the photograph, and magnetically attach the picture frame to a metal surface to display the photograph. Also disclosed is an embodiment wherein the card is a display card made from a magnetically attractive material.

7 Claims, 2 Drawing Sheets

FIG. 3
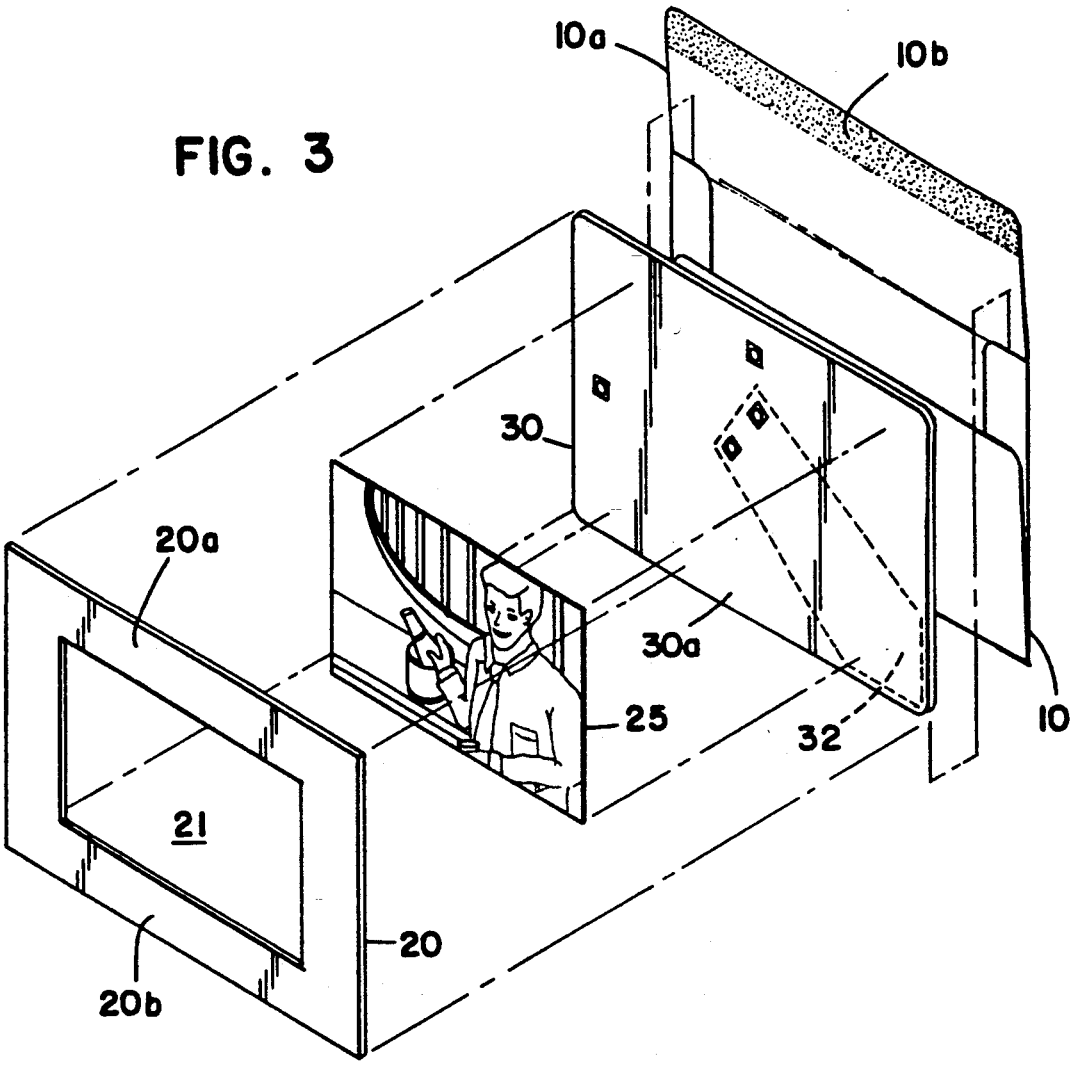
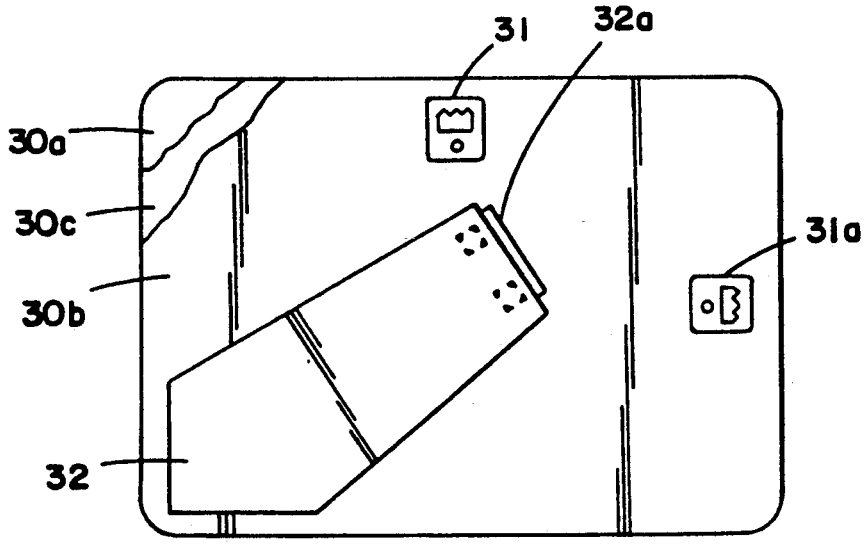
FIG. 4

COMBINED MAGNETIC PICTURE FRAME AND GIFT/DISPLAY CARD

CROSS-REFERENCE TO RELATED APPLICATION

This is a continuation-in-part of my prior co-pending application, Ser. No. 07/847,115, filed Mar. 6, 1992 now U.S. Pat. No. 5,261,174.

BACKGROUND OF THE INVENTION

1. Field of the Invention

The present invention is directed to a gift card having a surface carrying strips of releasable adhesive to which a picture frame made from a flexible magnetic (permanent magnet) sheeting material can be secured to display a photograph there between, the flexible magnetic sheeting material being removable for magnetic attachment to a metal surface to display the photograph. In a preferred embodiment of this application, the permanent magnet sheeting material is attached to a display card made of a material attractive to magnets.

2. Description of the Prior Art

Various mailers have been developed which permit a photograph to be displayed as part of a greeting card or the like. Persons receiving such photographs often display them by tacking them to bulletin boards, by taping them or adhesively securing them to various surfaces, or by using magnets to secure them to metal doors or refrigerators. None of the prior art arrangements have provided a means of both mailing a photograph in a decorative magnetic picture frame and also using the same magnetic picture frame to display the photograph on a vertical metal wall surface.

SUMMARY OF THE INVENTION

According to the present invention, a picture frame is constructed from a flexible magnetic (permanent magnet) sheeting material which can be attached to metal surfaces such as a metal door or the outer surfaces of a refrigerator. The sheeting material can be constructed as a picture frame suitable for displaying a photograph, and the front surface thereof can be imprinted to provide a decorative appearance. A gift card is also provided as part of a mailer which includes the picture frame. The gift card is provided with strips of releasable adhesive material so that the picture frame can be releasably attached to the gift card with a photograph displayed between the picture frame and the gift card so that the unit can be inserted in a mailing envelope for mailing to a recipient. Upon receipt of the mailer, the recipient can remove the flexible picture frame from the gift card, along with the photograph, and use the flexible magnetic picture frame to hold the photograph on a refrigerator or the like for display purposes. In another embodiment, the picture frame is magnetically attached to a display card or panel constructed from a material attractive to magnets instead of or in addition to the gift card.

BRIEF DESCRIPTION OF THE DRAWINGS

FIG. 3 is an exploded view in perspective of another embodiment wherein the permanent magnet picture frame is attached to a display card of magnetically attractive material; and FIG. 4 is a plan view of the rear face of the display card, portions thereof being broken away.

DESCRIPTION OF THE PREFERRED EMBODIMENTS

Figure 1:
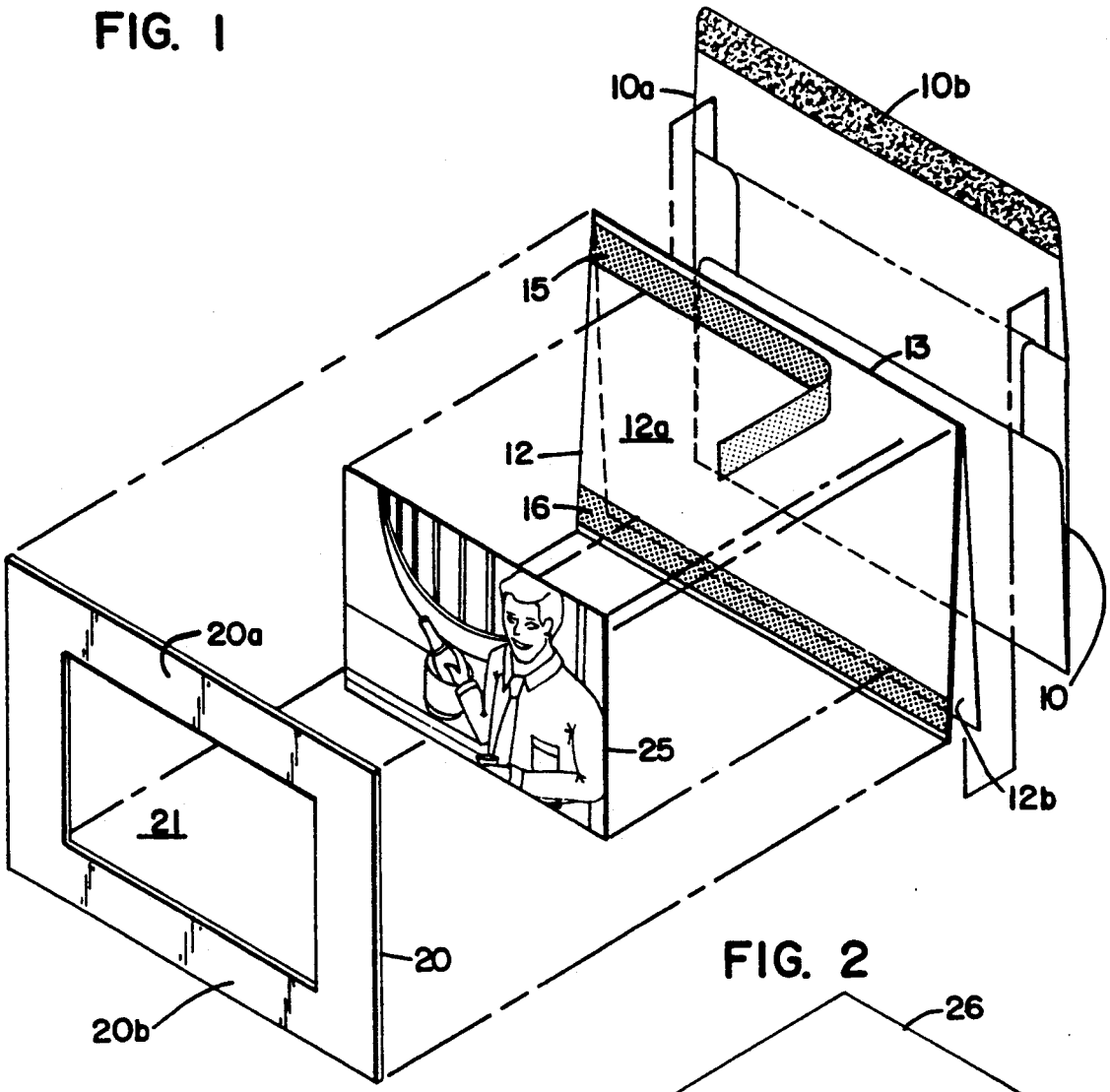
FIG. 1 is an exploded view in perspective of a combined magnetic picture frame and gift card mailer according to invention.

Referring to FIG. 1, there is disclosed a standard mailing envelope 10 approximately 5-inch by 7-inch in size having a flap 10*a* to close the envelope, flap 10*a* having an adhesive strip 10*b* for the purpose of sealing flap 10*a* against the envelope body.

A gift card 12 is provided which is made from folded card stock. Gift card 12 is a foldable sheet member having a first panel 12*a* and a second panel 12*b* of the same size and the panels are folded along a fold line 13 so that the resulting card 12 is sized to be inserted in envelope 10. Panel 12*a* has a front surface having mounted thereon two strips of double-sided adhesive tape 15 and 16. Tapes 15 and 16 comprise a carrier film having a high tack adhesive on one side for permanently securing the tape to the front surface of panel 12*a*, and a low tack "removable" adhesive on an opposite side. In this embodiment, tape strip 15 is of the rectangular panel 12*a*. Although strip 15 is shown to be spaced from adjacent fold 13, it could be positioned directly adjacent thereto without departing from the invention. In FIG. 1, tape strip 15 is shown with a portion of the strip secured to panel 12*a* and a portion folded away so that the adhesive on the opposite side can be seen. However, it is understood that the entire length of strip 15 would be applied against panel 12*a* in the same fashion as strip 16. Strip 16 is secured to panel 12*a* along the edge of panel 12*a* which is opposite from fold 13. Again, it is shown spaced from the edge but it could be positioned directly adjacent thereto depending upon the sizes of the photograph and picture frame to be used.

3M Company markets at least two different types of double-sided tape which can be used for strips 15 and 16. The tapes have adhesives on both sides of a film which functions as a carrier for the adhesives. A permanent high tack adhesive is placed on one side and a removable low tack adhesive is placed on the other side of the film. The tapes come with a liner which can be removed and discarded. One type of tape which can be used is identified as 3M Scotch Brand No. 9415, which has a poly-coated liner. Another type of tape which can be used is 3M Scotch Brand No. 928, which has a tissue liner. The ¾ inch wide No. 928 tape is preferable because it is less expensive than the No. 9415 tape. The removable adhesive is similar to that used on Post-it Brand notes. In this embodiment, a ¾ inch wide tape strip is used but again, other widths could be used depending upon the relationships involved.

Also shown in FIG. 1 is a picture frame 20 having a central opening 21, which is constructed from flexible magnetic (permanent magnet) sheeting material. Picture frame 20 is rectangular and is the same size as panel 12*a*. Picture frame 20 has an upper frame member 20*a* and a lower frame member 20*b* and members 20*a* and 20*b* are each one inch in width. The side frame members are each about 1-⅛ inches in width.

Upper and lower frame members 20*a*, 20*b* are spaced to make contact with tape strips 15, 16 for releasably securing frame 20 to the front surface of panel 12*a*. When picture frame 20 is moved into contact with tape strips 15, 16 the outwardly disposed releasable adhesive contacts frame members 20*a*, 20*b* to securely hold picture frame 20 in place against card 12. A photograph 25 can be placed against the front surface of panel 12*a* between tape strips 15, 16 so as to show through picture frame opening 21 but at the same time be held in place by the rear surface of the picture frame. The rectangular opening 21 is preferably smaller in size than photograph 25 so that a portion of frame 20 surrounding opening 21 lies against the edges of picture 25 to hold it in place. In the embodiment shown, a 3½ inch by 5 inch photograph 25 is shown but a 4 inch by 6 inch photo could also be displayed. Photograph 25 would thus basically fit between strips 15, 16 to be held in place by the overlying picture frame 20. However, the strips 15, 16 could be moved closer together so that the interior edges of strips 15, 16 would engage the upper and lower edges of the photograph. In either case, parallel strips 15, 16 are spaced and sized to extend beyond opposite edges of the photograph being displayed to leave their upper and lower edges free to secure picture frame 20 to panel 12*a*.

Picture frame 20 can be constructed from a commercially available flexible magnetic sheeting material called Koroseal. Koroseal is a thermoplastic permanent magnet material. The magnets embedded in the material are polarized so that the sheeting will be magnetically attracted to metal surfaces. The face of the Koroseal sheeting material can also be imprinted with messages or decorative material by screen printing, hot stamping, thermography or hand lettering. The Koroseal sheeting can be easily cut and trimmed into the desired shape. The preferred thickness of the material for this application is 0.020 inch.

It is intended that the picture frame 20, card 12 and envelope be sold as a unit to customers who wish to mail a selected photograph to another party. Thus, the customer would purchase the combination, would remove picture frame 20 from card 12 by peeling it away from the releasable adhesive on strips 15 and 16. The photograph 25 would then be positioned against the front surface of panel 12*a* between or slightly overlapping strips 15 and 16, and then picture frame 20 would be once again positioned against panel 12*a* to be held in place by the releasable adhesive on strips 15 and 16. The unit would then be mailed to another party who would remove the combined picture frame, photograph and gift card from the envelope, peel away picture frame 20 and remove photograph 25, which could then be mounted on a refrigerator 26 as shown FIG. 2. Because picture frame 20 is constructed from the magnetic sheeting, it will naturally be attracted to the metal door or side wall of refrigerator 26 and will hold the photograph in place so that it can be viewed through opening 21. Picture frame 20 can thus be attached to any metal surface such as the side of an oven or to a metal door. After the picture frame and photograph are removed from card 12, the card and mailing envelope 10 can be discarded if desired. Because picture frame 20 is made from magnetic material, no tacks, adhesives or magnets are needed to apply it to the refrigerator door and when it is removed, it will leave no residue behind. Once the recipient has the picture frame, it can be used over and over again to display different photographs or other materials in the same fashion.

Referring now to FIG. 3, there is disclosed an embodiment wherein card 12 is replaced by a display card 30 which is generally rectangular in shape and about the same size as picture frame 20. As shown in FIG. 4, display card 30 is a laminated panel having a thin front face 30*a* and a rear face 30*b* both made from thin cardboard or the like and an intermediate layer 30*c* sandwiched therebetween and adhesively secured thereto. Intermediate panel 30*c* is a thin, flat rectangular panel formed of any suitable magnetically attractive material such as soft iron. Thus, picture frame 20, which is made from a flexible permanent magnet material will magnetically adhere to display card 30 to hold photograph 25 therebetween. The arrangement is generally the same as previously described for the other embodiment except that the picture frame is now magnetically attached to the card 30. Once again, the combined picture frame and display card with photograph held therebetween can be inserted in a mailing envelope 10 for mailing to a recipient. Rear face 30*b* is provided with a pair of hook members 31, 31*a* which can be used to hang the unit on the wall to display the photograph. Rear face 30*b* is also provided with a hinged support leg 32 so that the display card can be made to stand like an easel to display the picture. In the embodiment shown, hook members 31, 31*a* are metal hooks attached by rivets or the like to display card 30 and leg member 32 is attached thereto by riveting a separate hinge 32*a* to both the leg member 32 and the card 30. Instead of this arrangement, the back panel could be a thicker piece of cardboard having the hook members and leg member integrally formed therewith by cutting them from the cardboard leaving one portion in each case as a hinge or attachment member.

Figure 2:
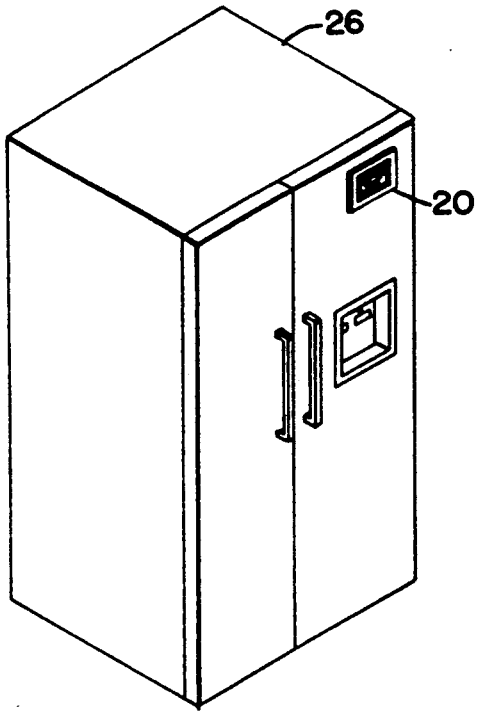
FIG. 2 a view in perspective of the front, top and one side of a refrigerator having the magnetic picture frame magnetically attached thereto for display of a picture.

The recipient of this unit, can, upon receipt, display the photograph by hanging it on a wall or using the display card 30 as an easel, or the recipient can again remove the frame 20 and picture 25 from the display card 30 and mount them on a different metal surface as for example, the surface shown in FIG. 2.

It will be apparent to those skilled in the art that a variety of modifications may be made to the product of the present invention without departing from the spirit and scope of the following appended claims.

What is claimed:

1. A combined permanent magnet picture frame and display card, comprising:

(a) a display card of magnetically attractive material having a front face, a rear face, and display card support means on said rear face;

(b) a removable picture frame, having frame members and a central opening, constructed from a permanent magnet sheet material and magnetically secured to said front face of said display card so that a photograph can be positioned therebetween for display through said opening, said removable frame being approximately the same size as said front face and being attachable to either said display card or to another metal surface.

2. The combined permanent magnet picture frame and display card of claim 1 wherein said picture frame has an opening which is smaller than the size of a photograph to be displayed therethrough and said frame being larger than said photographs to both engage said front face and also hold the photo in place between said frame and said front face.

3. The combined permanent picture frame and display card of claim 1 wherein said frame is cut from a sheet of flexible permanent magnet material and wherein said display card comprises a thin, flat, generally rectangular laminated panel having an inner layer constructed from a magnetically attractive material.

4. The combined permanent magnet picture frame and display card of claim 3 wherein said support means comprise hook members and a hinged support leg.

5. A combined picture frame and display card, comprising:

(a) a card of material attractive to magnets;

(b) a picture frame of permanent magnet material magnetically attached to said card;

(c) said picture frame having an opening and comprising a flexible sheet constructed and arranged for releasably securing said frame to said card so that a photograph can be positioned therebetween for display through said opening, said frame being removable from said card for magnetic attachment to a different display surface;

(d) said frame being cut from a sheet of flexible permanent magnet material and said display card comprising a panel of generally the same size as said picture frame; and (e) said display card having a front face for attachment to said picture frame, a rear face, and display card support means on said rear face.

6. The combined picture frame and display card of claim 5 wherein said support means comprise hook members and a hinged support leg.

7. The combined picture frame and display card of claim 6 in combination with a mailing envelope whereby the picture frame can be attached to the display card with a photograph held therebetween and inserted in said mailing envelope for mailing to a recipient.

* * * * *